US008878057B2

(12) United States Patent
Dahl

(10) Patent No.: US 8,878,057 B2
(45) Date of Patent: Nov. 4, 2014

(54) DEVICE FOR GROUNDING

(76) Inventor: Fredrik Dahl, Varberg (SE)

( * ) Notice: Subject to any disclaimer, the term of this patent is extended or adjusted under 35 U.S.C. 154(b) by 39 days.

(21) Appl. No.: 13/138,919

(22) PCT Filed: Apr. 6, 2010

(86) PCT No.: PCT/SE2010/000089

§ 371 (c)(1),
(2), (4) Date: Oct. 24, 2011

(87) PCT Pub. No.: WO2010/126421

PCT Pub. Date: Nov. 4, 2010

(65) Prior Publication Data

US 2012/0037393 A1 Feb. 16, 2012

(30) Foreign Application Priority Data

Apr. 27, 2009 (SE) ..... 0900565

(51) Int. Cl.
*H01R 4/66* (2006.01)
*H01B 9/00* (2006.01)
*H01B 5/08* (2006.01)

(52) U.S. Cl.
CPC . *H01B 9/006* (2013.01); *H01B 5/08* (2013.01)
USPC ..... 174/6; 174/78

(58) Field of Classification Search
USPC ..... 174/51, 126.2, 6, 78, 35 C, 40 CC, 130, 174/127, 128.1, 129 R; 61/53, 53.5, 63
See application file for complete search history.

(56) References Cited

U.S. PATENT DOCUMENTS

| | | | | |
|---|---|---|---|---|
| 3,255,300 | A * | 6/1966 | Bunish et al. | 174/130 |
| 4,106,299 | A * | 8/1978 | Fujii | 405/303 |
| 4,980,517 | A * | 12/1990 | Cardas | 174/129 R |
| 5,171,942 | A | 12/1992 | Powers | |
| 6,140,589 | A * | 10/2000 | Blackmore | 174/128.1 |
| 7,027,008 | B2 * | 4/2006 | Baker | 343/890 |
| 7,228,627 | B1 * | 6/2007 | Yoshimura et al. | 29/872 |
| 7,326,854 | B2 * | 2/2008 | Varkey | 174/102 R |
| 2006/0254793 | A1 * | 11/2006 | Santos Lopez et al. | 174/36 |

FOREIGN PATENT DOCUMENTS

| | | |
|---|---|---|
| JP | 2000-243141 (A) | 9/2000 |
| JP | 2008-251267 (A) | 10/2008 |
| WO | WO 95/27989 (A1) | 10/1995 |

* cited by examiner

*Primary Examiner* — Boris Chervinsky
*Assistant Examiner* — Pete Lee
(74) *Attorney, Agent, or Firm* — McGinn IP Law Group, PLLC

(57) ABSTRACT

Device for establishing an efficient grounding of an installation of different types includes one or more cables, wherein the ground rail or ground conductor, ground rails or ground conductors or ground point or ground points of the installation being grounded by the one or more cables including a combination of electrically conductive wires or conductors in at least one inner core and at least one outer layer which surrounds the inner core wholly or partly, and the cable or the cables are laid in one and the same or each in a separate bore in ground and/or rock of a considerable depth, preferably more than 200 m, e.g. 240 m or more.

19 Claims, 2 Drawing Sheets

DEVICE FOR GROUNDING

The present invention relates to a device for establishing efficient grounding of installations of different types, e.g. of low tension and/or high tension current type and/or high voltage type, an antenna installation or a teleinstallation or combinations thereof, and a method of reducing the device into practice.

For maintaining as disruption-free operation as possible in electric installations of different types, e.g. low tension or high tension current type and/or high voltage type, in particular with extensive electronic equipment, computers, wireless networks, wireless telephones etc., an antenna installation of a teleinstallation or combinations of such installation, increasingly stringent demands are being placed on an efficient grounding of the installation for avoiding overtones and high impedances, which increase considerably at high frequencies. Thus, there is a large need in the art for a device for more efficient grounding of such installations than has hitherto been possible using conventional grounding devices.

The task forming the basis of the present invention is to satisfy the above-outlined needs in the art.

This task is solved according to the present invention in the device indicated by way of introduction, in that the device has been given the characterising features as set forth in appended Claim 1.

A device according to the present invention makes possible an extremely efficient grounding of an installation of the type disclosed by way of introduction in that substantially all overtones are deflected to earth. The deflection with the cable combination according to the present invention will be extremely efficient and has proved to make it possible for persons supersensitive to electricity to stay in a prototype installation according to the present invention. By means of a device according to the present invention, earth or ground fault currents, vagabond currents and electromagnetic fields are reduced or even totally eliminated.

One embodiment of the present invention will now be described in greater detail hereinbelow with reference to the accompanying Drawing.

Figure 6:
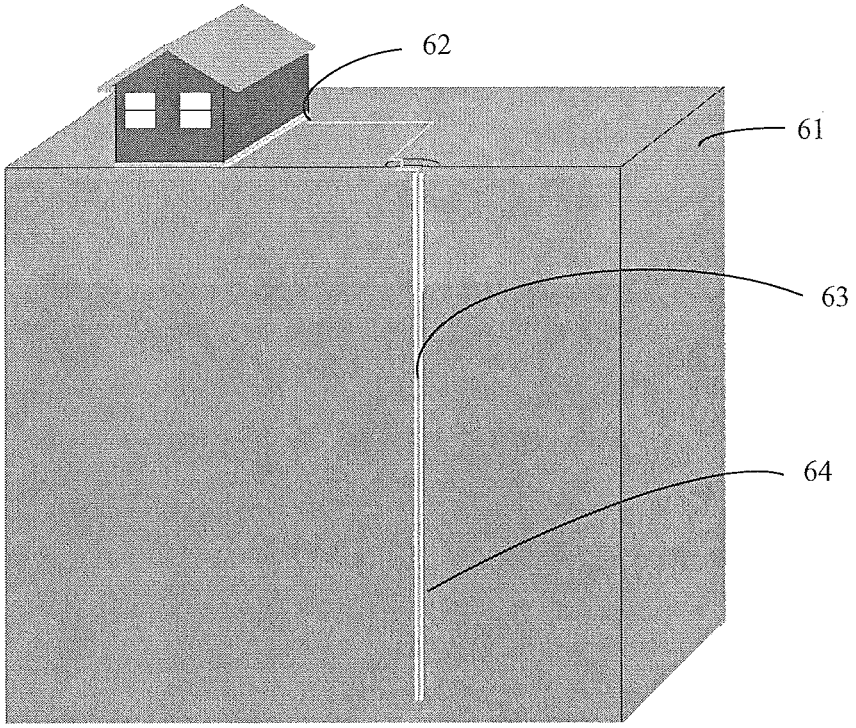
FIG. 6 shows grounding of a ground conductor with a cable laid in a bore in ground.

As shown in FIG. 6, in an exemplary aspect of the present invention, a ground conductor 62 is grounded by cable 63 in bore 64 of ground 61.

Figures 1, 2, 3, 4, 5:
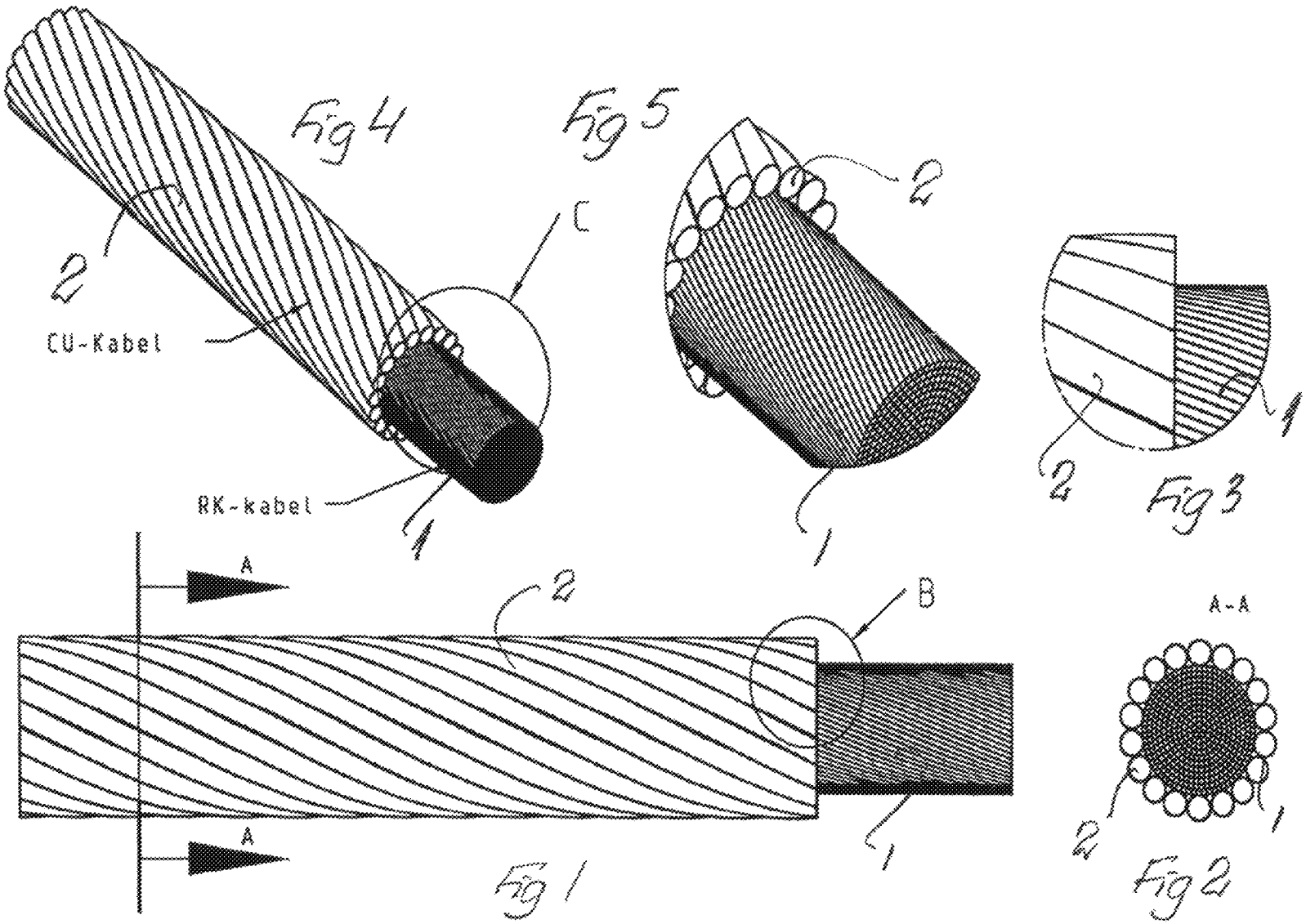
FIG. 1 shows a side elevation of a part of a device according to one embodiment of the present invention.
FIG. 2 shows a section through the part according to FIG. 1 in the direction of the arrows A-A.
FIG. 3 shows, on a larger scale, the part enclosed by a circle in FIG. 1.
FIG. 4 is a perspective view of the part of a device according to the present invention illustrated in FIG. 1.
FIG. 5 shows, on a larger scale, the part of the device according to the present invention enclosed by a circle in FIG. 4.

The part of a cable combination according to the present invention illustrated in FIG. 1 is merely a small part of a cable which is hundreds of meters in length. The device includes one or more cables, in which the ground rail or ground conductor, ground rails or ground conductors or ground point or ground points of the installation being grounded by the one or more cables. The cable includes an inner core 1 which is surrounded by an outer layer 2. The inner core 1 consists of large number of relatively thin wires which are twisted. The outer layer 2 surrounding the core 1 consists of a sufficient number of thicker wires for enclosing the inner core 1 formed by the thin wires.

The wires in the inner core 1 are solid copper wires having an approximate diameter of 0.5 mm. The wires in the outer layer 2 are solid copper wires with an approximate diameter of 2.2 mm. The surface area of the inner core 1 is substantially equally as large as the surface area of the surrounding outer layer 2. In one embodiment, the surface area of the inner core was approx. 70 $mm^2$ and the outer layer 2 have a surface are or approx 70 $mm^2$. The number of wires in the inner core 1 amounts to approximately 370, while the number of wires in the outer layer 2 is approximately 18. The number of wires in the inner core 1 is of particular importance for deflecting overtones, since these occur in the surface or outer layer of every conductor.

A cable combination according to the present invention may also be designated CU-RK combicable. Apart from being electrically conductive, the outer layer 2 also fulfils the function of protecting the inner core 1 from a mechanical viewpoint.

One particularly effective method of using the cable combination according to the present invention described in the foregoing is, from the zero rail or zero point of the electric installation, to lead the cable combination to a bore of a depth of approx. 240 m in order to make good contact with water in the bore. It is suitable to provide the bore with a lining tube or pipe to a depth of approx. 36 m and to connect the cable combination to the lining tube in careful electrically conductive fashion. The depth of the bore is of importance to avoid overtones and fields which are close to superficial parts of ground and rock. The deeper the bore, the greater part of the cable will be located in water.

In a prototype installation according to the present invention, such an extraordinary measurement value as 0.04 microwatt per square meter in air was achieved at a frequency of 800-2500 MHz. Further, in the installation a resistance in the ground conductor was measured of 0.08 ohm and even lower. This resistance was measured using an instrument entitled "Earth clamp tester" from Kyoritsu Model 4002 Kew Earth. Moreover, the electromagnetic field was measured to 0.02 microtesla at a frequency of 50 Hz and 0.05 microtesla at the frequency of between 5 and 2000 Hz. The earth's own magnetic field is 0.02 microtesla.

The cable combination according to the present invention may contain other electrically conductive material than copper or combinations thereof if such is deemed appropriate.

Many modifications are conceivable without departing from the scope of the inventive concept as defined in the appended Claims.

The invention claimed is:

1. A device for establishing grounding of an installation of different types, said device comprising: one or more cables, wherein a ground rail or a ground conductor, ground rails or ground conductors, or a ground point or ground points are grounded by the one or more cables comprising a combination of electrically conductive wires or conductors in at least one inner core and at least one outer layer which surrounds the inner core wholly or partly; and a bore extending, in at least one of ground and a rock, with a depth of more than 100 m, wherein the one or more cables are laid in the bore throughout the depth of more than 100 m, and wherein the electrically conductive wires or conductors in said at least one inner core include hundreds of thin conductors surrounded by said at least one outer layer that includes coarse conductors having a diameter more than a diameter of the thin conductors and wherein a ratio of a number of the thin conductors to a number of the coarse conductors is approximately 370/18.

2. The device as claimed in claim 1, wherein the wires or conductors in the inner core have substantially a same diameter and the wires or conductors in the outer layer surrounding the inner core have substantially a same diameter, which is larger than the diameter of the wires or conductors in the inner core.

3. The device as claimed in claim 2, wherein a surface area of all of the wires or the conductors in the core is substantially equal to a surface area of all of the wires or the conductors in the outer layer wholly or partly surrounding the inner core.

4. The device as claimed in claim 3, wherein a number of the wires or conductors in the inner core is greater than a number of the wires or conductors in the outer layer wholly or partly surrounding the inner core.

5. The device as claimed in claim 2, wherein the wires or the conductors in the inner core are solid and the wires or the conductors in the outer layer wholly or partly surrounding the inner core are solid.

6. The device as claimed in claim 4, wherein the wires or the conductors in the inner core and the outer layer wholly or partly surrounding the inner core comprise copper wires or copper conductors.

7. The device as claimed in claim 6, wherein the ground conductor or the ground conductors are electrically conductively interconnected to an electrically conductive lining tube or pipe in at least an upper region of the bore.

8. The device as claimed in claim 7, wherein the lining tube or pipe extends to a depth of more than 20 m.

9. The device as claimed in claim 3, wherein the wires or the conductors in the inner core are solid and the wires or the conductors in the outer layer wholly or partly surrounding the inner core are solid.

10. The device as claimed in claim 4, wherein the wires or the conductors in the inner core are solid and the wires or the conductors in the outer layer wholly or partly surrounding the inner core are solid.

11. The device as claimed in claim 5, wherein the wires or the conductors in the inner core and the outer layer wholly or partly surrounding the inner core comprise copper wires or copper conductors.

12. The device of claim 1, wherein the depth is more than 200 m.

13. The device of claim 12, wherein the depth is more than 240 m.

14. The device of claim 8, wherein the depth that the lining tube or pipe extends is at least 36 m.

15. The device of claim 1, where in the installation comprises at least one of a low tension current type installation, a high tension current type installation, a high voltage type installation, an antenna installation, and a teleinstallation.

16. The device of claim 1, wherein the one or more cables extend throughout the bore to contact water in the bore.

17. The device of claim 1, wherein the bore comprises a lining tube that is electrically connected to the ground conductor or the ground conductors.

18. A device for grounding of a conductor, said device comprising:

at least one cable comprising at least one inner core and at least one outer layer which surrounds the inner core; and a bore extending, in at least one of ground and a rock, with a depth of more than 100 m, wherein the at least one cable is laid in the bore throughout the depth of more than 100 m, and wherein said at least one inner core comprises hundreds of thin conductors surrounded by said at least one outer layer that includes coarse conductors having a diameter more than a diameter of the thin conductors.

19. The device of claim 18, wherein the at least one cable extends throughout the bore to contact water in the bore, and wherein the bore comprises a lining tube that is electrically connected to the conductor.

* * * * *